US006247508B1

(12) United States Patent
Negley, III et al.

(10) Patent No.: US 6,247,508 B1
(45) Date of Patent: Jun. 19, 2001

(54) VAPOR RECOVERY SYSTEM AND METHOD WITH LEAKAGE AND AIR FLOW SENSING

(75) Inventors: Scott Robertson Negley, III; Gary Michael Ostrowski, both of Salisbury, MD (US)

(73) Assignee: Dresser Equipment Group, Inc., Carrollton, TX (US)

( * ) Notice: Subject to any disclaimer, the term of this patent is extended or adjusted under 35 U.S.C. 154(b) by 0 days.

(21) Appl. No.: 09/525,413

(22) Filed: Mar. 15, 2000

Related U.S. Application Data

(60) Provisional application No. 60/125,028, filed on Mar. 18, 1999.

(51) Int. Cl.[7] ..... B65B 1/04

(52) U.S. Cl. ..... 141/94; 141/83; 73/40.5

(58) Field of Search ..... 141/83, 94, 59, 141/95; 73/40, 40.5 R, 40.5 A

(56) References Cited

U.S. PATENT DOCUMENTS

| | | | | |
|---|---|---|---|---|
| 3,866,798 | | 2/1975 | Marsh | 222/52 |
| 3,940,020 | | 2/1976 | McCrory et al. | 222/52 |
| 4,410,109 | | 10/1983 | Murrell, Jr. et al. | 222/52 |
| 4,658,986 | | 4/1987 | Freed et al. | 222/52 |
| 5,014,543 | | 5/1991 | Franklin et al. | 73/40.5 |
| 5,072,621 | | 12/1991 | Hasselmann | 73/40.5 |
| 5,220,822 | * | 6/1993 | Tuma | 73/40.5 |
| 5,450,883 | | 9/1995 | Payne et al. | 141/59 |
| 5,501,577 | | 3/1996 | Cornell et al. | 417/9 |
| 5,526,679 | | 6/1996 | Filippi et al. | 73/40.5 |
| 5,557,965 | | 9/1996 | Fiechtner | 73/49.2 |
| 5,715,875 | * | 2/1998 | Clary et al. | 141/59 |
| 5,857,500 | | 1/1999 | Payne et al. | 141/59 |
| 6,070,453 | * | 6/2000 | Myers | 73/40.5 |
| 6,082,415 | * | 7/2000 | Rowland et al. | 141/59 |

* cited by examiner

*Primary Examiner*—Steven O. Douglas
(74) *Attorney, Agent, or Firm*—Haynes and Boone, LLP

(57) ABSTRACT

A system and method for recovering a gasoline vapor/air mixture from a vehicle tank during the dispensing of a gasoline from a storage tank into the vehicle tank, according to which a flow line is established for the flow of the mixture from the vehicle tank to the storage tank during the dispensing. A pump is activated during the dispensing to flow the mixture from the vehicle tank to the storage tank, and the mixture flow is terminated in response to the termination of the dispensing. The pump is then activated to pressurize the flow line after which any reduction in the pressure of the mixture in the flow line is sensed. According to another embodiment, the mixture flow is terminated in response to termination of the dispensing and ambient air is introduced into the flow line. The pump is activated to pump the ambient air at a desired flow rate, and the flow rate of the air through the flow line is sensed. This latter flow rate can be compared to known pump performance data to determine the performance of the pump.

19 Claims, 1 Drawing Sheet

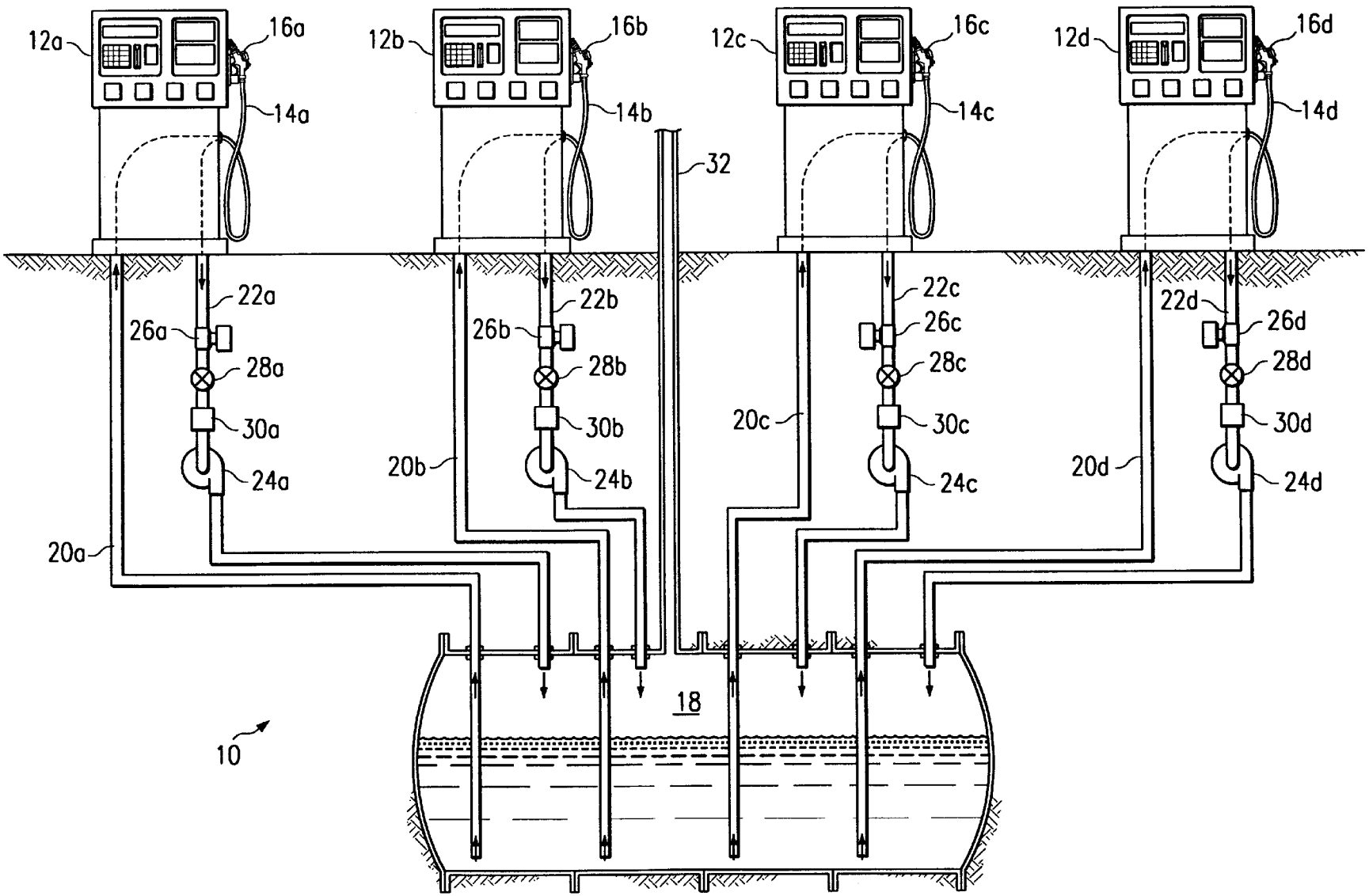
16d
14d
12d
22d
26d
28d
30d
24d
20d
16c
14c
12c
22c
26c
28c
30c
24c
20c
32
18
16b
14b
12b
22b
26b
28b
30b
24b
20b
16a
14a
12a
22a
26a
28a
30a
24a
20a
10

VAPOR RECOVERY SYSTEM AND METHOD WITH LEAKAGE AND AIR FLOW SENSING

CROSS-REFERENCE TO RELATED APPLICATIONS

This application is based on, and claims priority of, provisional application Ser. No. 60/125,028 filed on Mar. 18, 1999.

BACKGROUND OF THE INVENTION

This invention relates to a vapor recovery system and method for use in connection with a gasoline dispensing system, and, more particularly, to such a system and method for detecting for leakage in the vapor recovery system.

In general, gasoline dispensing and vapor recovery systems include one or more dispenser units, with each unit being connected to an underground storage tank for gasoline. Each unit has one or more nozzles for dispensing the gasoline into a vehicle fuel tank, and passages are provided in each nozzle for collecting the vapor/air mixture from the vehicle tank. A return line is connected to the vapor/air mixture passage for delivering the collected vapor/air mixture back to the underground fuel storage tank.

These types of systems include passive systems that rely solely upon vapor/air mixture pressure within the fuel tank to force the vapor/air mixture through the vapor/air mixture return line. However, due to pressure losses and partial obstructions in the vapor/air mixture recovery line (sometimes caused by fuel splash-back or condensation), the vapor/air mixture pressure developed in the vehicle fuel tank is often insufficient to force the vapor/air mixture out of the vehicle tank and to the underground storage tank.

Active vapor recovery systems and methods have also evolved that employ a vacuum pump for drawing the vapor/air mixture from the vehicle tank and through a vapor/air mixture return line. Some of these systems, such as the system disclosed in co-pending patent application Ser. No. 08/515,484, assigned to the assignee of the present invention, provide a relatively powerful, continuously-operating, vacuum pump and a valve arrangement for connecting the various vapor/air mixture return lines to the vacuum pump. Other active systems, such as a system marketed by the assignee of the present invention under the "WAYNE VAC" designation, employ a vacuum pump at each dispenser unit which is connected to a vapor/air mixture return line. These systems have proven to be relatively easy to use and customer-friendly.

In these active vapor recovery systems, to insure optimal efficiency it is essential that there be no leakage of vapor from the vapor recovery system including the conduit connecting the dispensing nozzle(s) to the underground storage tank, and from the components connected to the conduit. However, there is no acceptable or reliable technique for detecting this type of leakage, especially a technique that can be utilized by a relatively unskilled person. Therefore, since a leakage of this nature can create significant system operational inefficiencies, it is important that a technique for sensing the leakage be available. In this context, it is also important that the vacuum pump perform at acceptable standards.

Therefore, what is needed is vapor recovery system and method of the above type according to which leakage in the system, as well as vacuum pump performance, can easily be sensed.

SUMMARY OF THE INVENTION

The present disclosure is directed, in general, to a system and method for recovering a mixture of air and gasoline vapors associated with a gasoline dispensing system. According to one embodiment, a passage is established for the flow of the mixture from the vehicle tank to the storage tank during the dispensing of the gasoline. A vacuum pump is activated during the dispensing of the gasoline to flow the vapors from the vehicle tank to the storage tank in proportion to the amount of gasoline dispensed, and the mixture flow is terminated in response to the termination of the dispensing. The pump is then activated to pressurize the passage in a closed system after which any reduction in the pressure of the mixture in the passage is sensed.

According to another embodiment, the mixture flow is terminated in response to termination of the dispensing of the gasoline, and ambient air is introduced into the passage. The pump is activated to pump the ambient air at a desired flow rate, and the actual flow rate of the air through the passage is sensed. This latter flow rate can be compared to known pump performance data to determine the performance of the pump.

The system and method of the present invention thus enjoy the advantage of enabling an operator or owner of a service station to easily detect any leakage in the vapor recovery system associated with the gasoline dispensing system and/or any malfunctioning of the vacuum pump.

BRIEF DESCRIPTION OF THE DRAWING

The drawing is a schematic view of an embodiment of the system of the present invention.

DETAILED DESCRIPTION

Referring to the drawing, the reference numeral 10 refers, in general, to a service station installation for dispensing gasoline to vehicles. To this end, four dispenser housings 12*a*–12*d* are provided which are respectively provided with hose assemblies 14*a*–14*d* which, in turn, have dispensing nozzles 16*a*–16*d,* respectively, affixed to one end thereof.

An underground gasoline storage tank 18 is provided immediately below the dispenser housings 12*a*–12*d* and is connected by four conduits 20*a*–20*d* to the dispenser housings 12*a*–12*d,* respectively. Although not shown in the drawings for the convenience of presentation, it is understood that one or more pumps and flow meters are associated with the conduits 20*a*–20*d* for pumping the gasoline to the dispenser housings 12*a*–12*d* and for metering the flow of the gasoline, respectively.

The conduits 20*a*–20*d* are connected to the hose assemblies 14*a*–14*d* in the interior of the dispenser housings 12*a*–12*d* for passing the fuel to the dispensing nozzles 16*a*–16*d,* which, in turn, discharge the gasoline into the fuel tanks of vehicles being serviced. It is also understood that two passages are defined in each hose assembly 14*a*–14*d* by a coaxial arrangement of two hoses, for respectively dispensing the gasoline through one of the hoses and for receiving the displaced vapor/air mixture from the vehicle tank in the other hose, as will be described.

Four vapor recovery conduits 22*a*–22*d* extend from the hoses 14*a*–14*d,* respectively, to the underground storage tank 18 for passing the recovered mixture to the tank. Four vacuum pumps 24*a*–24*d* are connected to the vapor recovery conduits 22*a*–22*d,* respectively, for drawing the vapor/air mixture from the vehicle tanks through the nozzles 16*a*–16*d* and the hoses 14*a*–14*d,* respectively.

Four pressure sensors 26*a*–26*d* are connected in the vapor recovery conduits 22*a*–22*d,* respectively, upstream of the corresponding vacuum pumps 24*a*–24*d* for sensing vapor pressure in the conduits under conditions to be described. Since the pressure sensors 26*a*–26*d* are conventional they will not be described in any further detail.

Four three-way valves 28*a*–28*d* are connected to the conduits 22*a*–22*d,* respectively, and extend between the pressure sensors 26*a*–26*d* and the vacuum pumps 24*a*–24*d,* respectively. Each valve 28*a*–28*d* is movable to a first position in which it blocks the flow of the recovered mixture through its corresponding conduit 22*a*–22*d,* a second position in which it permits this flow, and a third position in which it blocks the flow and is connected to atmosphere to permit the ingress of atmospheric air into its corresponding conduit, for reasons to be described. Since the valves 28*a*–28*d* are conventional they will not be described in any further detail.

Four air flow sensors 30*a*–30*d* are connected in the vapor recovery conduits 22*a*–22*d,* respectively, just upstream of the corresponding vacuum pumps 24*a*–24*d* for sensing air flow in the conduits and for giving a visual indication of the air flow in the conduits, under conditions to be described.

A vent pipe 32 extends from the underground storage tank 18 to a height above ground for the purpose of venting the tank when the vapor pressure in the tank exceeds a predetermined value.

In operation, and assuming that a vehicle is to be serviced by the dispenser housing 12*a*, a master switch, or the like, provided on the dispenser housing 12*a* is activated to actuate the gasoline pump (not shown) associated with the conduit 20*a*. The nozzle 16*a* is inserted into the vehicle tank and actuated, causing gasoline to flow from the storage tank 18, through the conduit 20*a* and the gasoline hose in the hose assembly 14*a*, to the nozzle 16*a,* and into the vehicle tank for dispensing. The valve 28*a* is maintained in an open position and the resulting gasoline flow actuates the vacuum pump 24*a* to pump a mixture of gasoline vapor and air from the vehicle tank to the storage tank, with the flow of the mixture being proportion to the gasoline flow, as disclosed in the above-identified WAYNE VAC system. Since these types of switches and controllers are well known, they are not shown and will not be described in detail.

Of course, at the conclusion of the dispensing operation, the nozzle 16*a* is returned to the dispenser housing 12*a* and the gasoline pump and the vacuum pump 24*a* are shut off and reset for the next vehicle to be serviced.

According to an embodiment of the present invention, the system can be pressure tested for leaks when the gasoline dispensing and the vapor recovery systems are not in use. More particularly, to initiate a pressure test in connection with the vapor recovery system associated with the dispenser 12*a*, for example, the valve 28*a* is maintained in its open position and the vacuum pump 24*a* is activated to run in a reverse, pressurizing mode for a few seconds. This will pressurize the conduit 22*a* with fluid from the tank 18 after which the pump 24*a* is turned off and the valve 28*a* is closed. This creates a closed, pressurized, fluid system in the conduit 22*a* extending from the shut-off nozzle 16*a* to the valve 28*a*. The pressure sensor 26*a* is activated to sense the pressure in the conduit 22*a* and produce an output signal which can be visually displayed and/or recorded in any conventional manner. Therefore, an initial reading may be taken that corresponds to the pressure in the latter closed system. Then after a predetermined time elapses, another reading can be taken to ascertain any decrease, or decay, in the pressure in the closed system. If there is such a release, or decay, an alarm can be activated and/or the above-mentioned system master switch can be disabled in response to the detection of a leakage condition. During this process the air flow sensors 30*a*–30*d* are not utilized. It is understood that the same results can be achieved if the pump 24*a* is run a vacuum mode to create a vacuum which is measured by the sensor 26*a*.

It is understood that the techniques of determining the pressure in the conduits 22*b*–22*d* are identical to that described above.

According to another feature of an embodiment of the present invention, the performance of the vacuum pumps 24*a*–24*d* can be tested. More particularly, to initiate a test in this respect in connection with the vacuum pump 24*a*, for example, the valve 28*a* would be moved to a position in which it blocks the flow of vapor through the conduit 22*a* but permits the ingress of ambient air into the valve and therefore into the conduit 22*a*. The pump 24*a* is run at a desired speed via simulated pulses corresponding to a desired fuel flow rate, and the air flow sensor 30*a* is maintained in a constant "on" condition. The pump 24*a* draws air into the conduit 22*a* and the amount of air flow through the conduit 22*a* is sensed by the air flow sensor 30*a* which produces an output signal that corresponds to the air flow performance of the pump 24*a* which can be visually displayed and/or recorded in any conventional manner. This data corresponds to the performance of the pump 24 and can be compared to known minimum pump performance criteria at the desired flow rate. If the performance of the pump 24*a* falls below a predetermined standard, an alarm can be activated and/or the above-mentioned system master switch can be disabled as discussed above. During this process the pressure sensors 26*a*–26*d* are not utilized.

It is understood that the techniques of determining the performance of the pumps 24*b*–24*d* are identical to that described above. It is also understood that both of the above tests can be controlled by software so that the testing is done automatically at predetermined intervals As a result of the above, the system and method of the present invention enjoy several advantages. For example, an operator or owner of a service station can easily detect any leakage in the vapor recovery system associated with the gasoline dispensing system and/or any malfunctioning of the vacuum pump, to enable the leakage or malfunction to be corrected before a hazardous environment is created.

It is understood that several variations may be made in the foregoing without departing from the scope of the invention. For example, the pressure and air-flow sensors can be in a location in the system of the present invention other than the location described above, and, in fact, can be integrated with their corresponding valves. Further, the relative location of the vacuum pumps, the pressure sensors, the valves, and the air flow sensors in their respective conduits can be varied within the scope of the invention. Also, flow-inducing members other than vacuum pumps can be used to induce the flow of the vapor/air mixture from the vehicle tank to the storage tank.

It is understood that, although the terms "conduit," "hose," "tube" , and "pipes" have been used above, these terms can be used interchangeably and can be in the form of any type of flow line that permits the flow of fluid. Also, more than one underground storage tank, similar to the tank 18, can be provided for storing different grades of gasoline and a blending chamber, or valve, can be included to make available multiple grades of fuel. Of course, the number of vacuum pumps used in the system of the present invention can vary within the scope of the invention.

Still other modifications, changes and substitutions are intended in the foregoing disclosure and in some instances some features of the invention will be employed without a corresponding use of other features. Accordingly, it is appropriate that the appended claims are construed broadly and in a manner consistent with the scope of the invention.

What is claimed is:

1. A testing method for use in connection with a gasoline vapor/air mixture recovery system according to which a vacuum pump flows the mixture in a passage from a vehicle tank to a storage tank during the dispensing of gasoline from the storage tank into the vehicle tank, the method comprising the steps of terminating the mixture flow in response to termination of the dispensing, then activating the pump to pressurize the passage, and then sensing any reduction in the pressure in the passage corresponding to a leakage in the passage.

2. The method of claim 1 further comprising the step of providing a visual indication of the pressure to enable any leakage to be determined.

3. The method of claim 1 further comprising the step of sounding an alarm when any reduction in pressure is sensed.

4. The method of claim 1 further comprising the step of disabling the gasoline dispensing when any reduction in pressure is sensed.

5. The method of claim 1 wherein the pump normally operates as a vacuum pump to draw the mixture from the vehicle tank to the storage tank, and wherein, during the step of activating, the operation of the pump is reversed to pressurize the passage.

6. A system for recovering a gasoline vapor/air mixture from a vehicle tank during the dispensing of gasoline from a storage tank into the vehicle tank, the system comprising a flow line connecting the vehicle tank to the storage tank, a valve disposed in the flow line for moving to an open position in which it permits fluid flow through the flow line, a pump adapted to be activated for flowing the mixture from the vehicle tank, through the flow line, and to the storage tank during dispensing of the gasoline after which the pump is deactivated, the valve being movable to a closed position and the pump adapted to be activated for pressurizing the flow line, and a sensor connected in the flow line for sensing the pressure in the flow line after it has been pressurized.

7. The system of claim 6 wherein the sensor is disposed in the flow line upstream of the pump.

8. The system of claim 6 further comprising a nozzle assembly for dispensing the gasoline into the vehicle tank and receiving the mixture from the vehicle tank, the flow line connecting the nozzle assembly to the storage tank for permitting the mixture to flow from the nozzle assembly to the storage tank, the closing of the valve and the activation of the pump pressurizing that portion of the flow line extending between the valve and the nozzle assembly.

9. A testing method for use in connection with a gasoline vapor/air mixture recovery system according to which a vacuum pump flows the mixture in a flow line extending from a vehicle tank to a storage tank during the dispensing of gasoline from the storage tank into the vehicle tank, the method comprising the steps of terminating the mixture flow in the flow line in response to termination of the dispensing, opening the flow line to ambient air, then activating the pump to pump the ambient air at a desired flow rate into and through the flow line, sensing the actual flow rate of the air through the flow line to determine the performance of the pump, then comparing this performance to known pump performance criteria at the given flow rate.

10. The method of claim 9 further comprising the step of providing a visual indication of the flow rate of the air through the passage.

11. The method of claim 9 further comprising the step of sounding an alarm when the flow rate of the air through the passage falls below a predetermined standard.

12. The method of claim 9 further comprising the step of disabling the gasoline dispensing when the flow rate of the air through the passage falls below a predetermined standard.

13. The method of claim 9 wherein the step of opening comprises the step of providing a valve that is movable into the flow line to a position in which it terminates the flow of the mixture through the flow line and opens the flow line to allow air to pass through the valve and into the flow line.

14. The method of claim 13 wherein the valve is movable to a position in which it opens the flow line to allow the flow of mixture through the flow line, and closes the flow line to the passage of air into the flow line.

15. A system for recovering a gasoline vapor/air mixture from a vehicle tank during the dispensing of gasoline from a storage tank into the vehicle tank, the system comprising a flow line connecting the vehicle tank to the storage tank, a pump for flowing the mixture from the vehicle tank, through the flow line, and to the storage tank during dispensing of the gasoline, a valve disposed in the flow line for terminating the flow of mixture through the flow line and flowing ambient air through the flow line at a desired flow rate, and a sensor for sensing the actual flow rate of the air through the flow line so that the performance data of the pump when pumping the air can be compared to known pump performance criteria at the given flow rate.

16. The system of claim 15 wherein the valve is movable into the flow line to a position in which it terminates the flow of the mixture through the flow line and opens the flow line to allow air to pass through the valve and into the flow line.

17. The system of claim 16 wherein the valve is movable to a position in which it opens the flow line to allow the flow of mixture through the flow line, and closes the flow line to the passage of air into the flow line.

18. The system of claim 15 wherein the sensor is disposed in the flow line upstream of the pump.

19. The system of claim 15 further comprising a nozzle assembly for dispensing the gasoline into the vehicle tank and receiving the mixture from the vehicle tank, the flow line connecting the nozzle assembly to the storage tank for permitting the mixture to flow from the nozzle assembly to the storage tank.

* * * * *